US005630760A

United States Patent [19]

Brown et al.

[11] Patent Number: 5,630,760

[45] Date of Patent: May 20, 1997

[54] CONVERTIBLE GAME TABLE

[75] Inventors: Patrick Brown, Strongsville; Joseph C. Cacciola; William K. Ford, both of Hudson; Raymond J. Fritz, Maple Heights; John R. Nottingham, Chagrin Falls; John W. Spirk, Gates Mills, all of Ohio

[73] Assignee: The Little Tikes Company, Hudson, Ohio

[21] Appl. No.: 384,757

[22] Filed: Feb. 7, 1995

[51] Int. Cl.[6] ..... A63F 7/06

[52] U.S. Cl. ..... 473/108.52; 273/317.3

[58] Field of Search ..... 273/85 R, 85 C, 273/85 D, 85 F, 108.52, 108.54, 317.3

[56] References Cited

U.S. PATENT DOCUMENTS

| | | | |
|---|---|---|---|
| D. 314,985 | 2/1991 | Monneret . | |
| D. 315,007 | 2/1991 | Monneret . | |
| D. 352,969 | 11/1994 | Cecchetti . | |
| 572,688 | 12/1896 | Seifert . | |
| 2,215,687 | 9/1940 | Carter . | |
| 2,595,725 | 5/1952 | Sutton . | |
| 2,769,638 | 11/1956 | Knapp . | |
| 2,818,256 | 12/1957 | Hopper . | |
| 3,001,843 | 9/1961 | Davis . | |
| 3,574,350 | 4/1971 | May | 273/85 D |
| 3,724,851 | 4/1973 | Cecchetti . | |
| 3,822,886 | 7/1974 | Cecchetti . | |
| 3,931,970 | 1/1976 | Cecchetti . | |
| 4,025,073 | 5/1977 | Furr et al. . | |
| 4,063,728 | 12/1977 | Zemanek . | |
| 4,334,682 | 6/1982 | Ham . | |
| 4,382,598 | 5/1983 | McCloud | 273/85 D |
| 4,722,530 | 2/1988 | Hendon . | |
| 4,873,679 | 10/1989 | Bohaski et al. . | |
| 5,112,047 | 5/1992 | Jouets . | |
| 5,242,164 | 9/1993 | Nicoll . | |
| 5,326,102 | 7/1994 | Chang | 273/85 D |
| 5,342,050 | 8/1994 | Thompson . | |

FOREIGN PATENT DOCUMENTS

| | | |
|---|---|---|
| 1069908 | 7/1954 | France . |
| 1492898 | 7/1967 | France . |
| 7311035 | 10/1974 | France . |
| 2647450 | 4/1978 | Germany . |
| 2932518 | 2/1981 | Germany . |
| 341564 | 1/1931 | United Kingdom . |
| 1107449 | 7/1966 | United Kingdom . |

OTHER PUBLICATIONS

P. 120, Game table; Buddy L Inc., Patch Road RD 1, P. O. Box 1070, Gloversville, New York 12078. Published at least as early as Jan., 1995.

P. 489, Game tables, Sears Wish Book, Chicago, Illinois. Publication date 1993.

Pp. 128, 129 and 131, Game tables; Service Merchandise Co., Inc., P. O. Box 25130, Nashville, Tennessee 37202–5130. Publication date 1994.

Pp. 69 and 70, Game tables; Fisher–Price, 620 Girard Avenue, East Aurora, New York 14052. Publication date 1994.

P. 490, Game tables; BEST Products Co., Inc., P. O. Box 26303, Richmond, Virginia 23260. Publication date 1993/94.

*Primary Examiner*—Sebastiano Passaniti

*Attorney, Agent, or Firm*—Richard B. O'Planick; Lisa B. Riedesel

[57] ABSTRACT

A convertible game table 10 which may be used to play a variety of games including foosball, basketball, and glide hockey. The game table 10 includes side walls 14 with recesses 42 for selectively retaining clip members 44. The clip members 44 provide support for rod assemblies 38 carrying miniature players 38 which extend crosswise between the side walls 14. The clip members 44 may be retained within the side wall recesses 42 when the locking member 62 adjacent to the side wall 14 is occupying a closed position. When the locking member 62 is occupying an open position, the clip members 44 may be easily removed from the side wall recesses 42. The clip members 44 and rod assemblies 36 may be easily stored when not in use to allow the convertible game table 10 to be utilized for a different game.

8 Claims, 10 Drawing Sheets

CONVERTIBLE GAME TABLE

FIELD OF THE INVENTION

The present invention relates to improvements in convertible game tables including foosball as one of the selected games, and more specifically to such convertible game tables which may be easily assembled and disassembled, both for storage purposes and assembly of the different games.

THE PRIOR ART

Convertible game tables including foosball as one of the selected games and foosball tables are well accepted game related items for children of various ages. Typical foosball game tables include a game table having rods for carrying players, wherein the rods extend crosswise between two side walls. In existing foosball tables the rods are retained either permanently within apertures within the side walls, or temporarily within seats oriented within the upper side borders of the side walls as illustrated in U.S. Pat. Nos. 4,025,073 and 3,724,851, respectively. Both of these embodiments pose disadvantages to the consumer. For example the foosball table, containing rods which are permanently or temporarily slideably, retained within apertures in the side wall, is difficult to ship and store due to the size of the overall table. In contrast, the foosball table, containing rods retained within seats on the upper portion of the side walls, may be difficult to assemble and disassemble despite its ability to be more easily shipped and stored. Therefore, a need exists for a foosball table which can be easily disassembled for shipping and storage purposes, as well as easily assembled by the user into a foosball game table and a variety of other game tables.

SUMMARY OF THE INVENTION

The present invention overcomes the disadvantages in the prior art by providing for an improved convertible game table containing a foosball game table, and a variety of other game tables which are easy to assemble and disassemble. In addition, since the table can be shipped in an unassembled condition the table is easier to ship and store than an assembled table. The present convertible table depicts a table which may be used in a variety of ways such as a game table for foosball, basketball, and glide hockey and as a drawing table. The convertible table includes side walls and end walls which form a walled element around a first base member. The side walls support rods carrying miniature players for contacting a ball. The rods have clip members secured adjacent to either ends, whereby the clip members may be retained within recesses within the table side walls. Locking members, adjacent to the table side walls, easily control when the clip members can be removed from the side wall recesses. When the clip members are removed from the side wall recesses they may be stored in apertures within the first base member. A second base member is the convertible game table surface, and may be used to play a variety of games. The convertible game table also includes a cover, which may also be used as a backboard in the basketball game.

Accordingly it is an objective of the present invention to provide for a convertible game table which is easy to assemble and disassemble for storage and shipping purposes.

A further objective of the present invention is to provide for a convertible game table which is easy to assemble and disassemble for people of a variety of ages.

A still further objective of the present invention is to provide for a convertible game table which can be assembled into a variety of games including foosball, basketball, glide hockey and a drawing table.

Yet a further objective of the present invention is to provide for a convertible game table which includes rods carrying miniature players, whereby the rods can be easily secured to the game table.

Another objective of the present invention is to provide for a convertible game table which is economically produced and conveniently utilized.

These and other objectives, which will be apparent to those skilled in the art, are achieved by a preferred embodiment which is described in detail below and which is illustrated in the accompanying drawings.

DESCRIPTION OF THE PREFERRED EMBODIMENT

Figure 1:
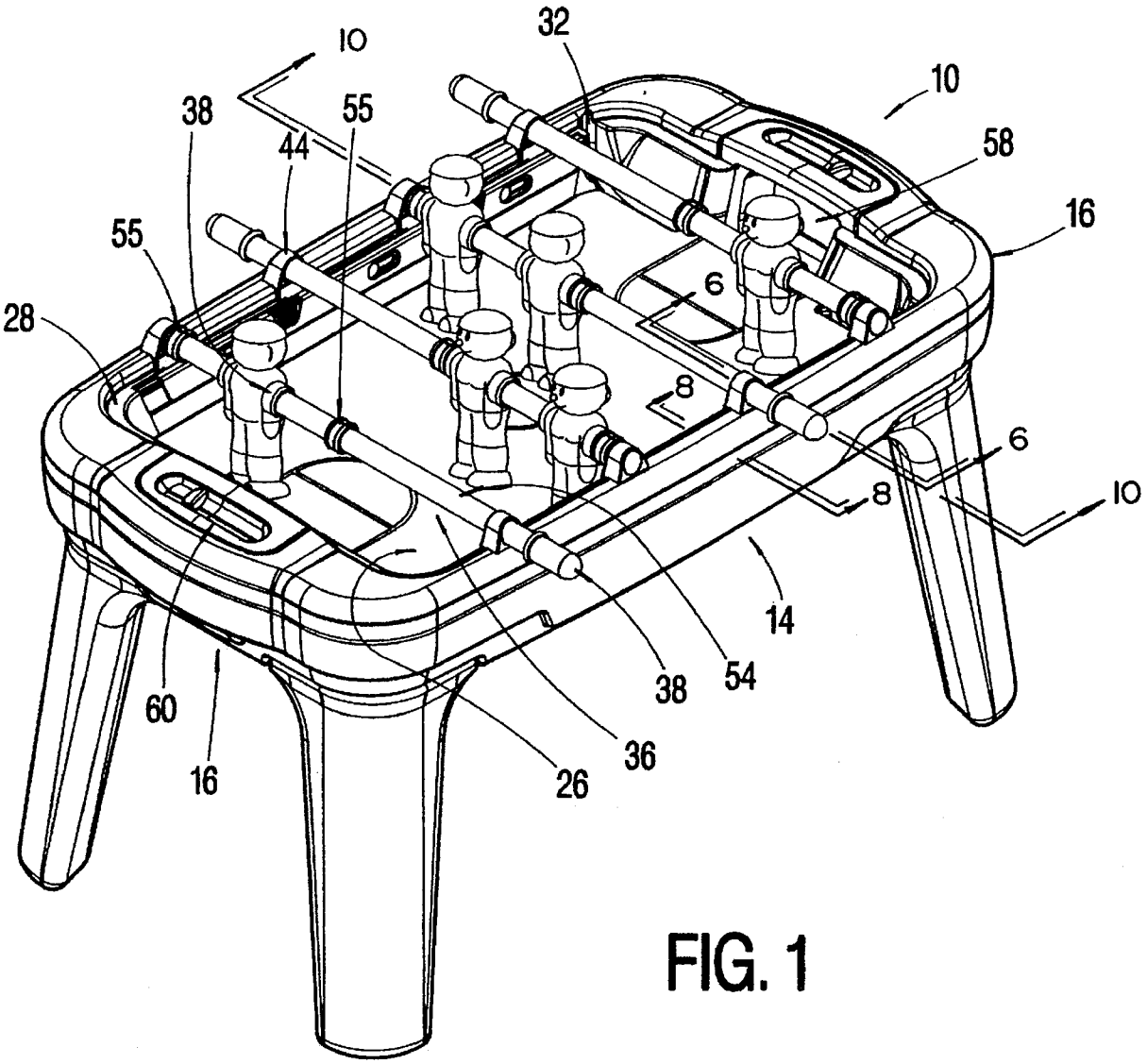
FIG. 1 is a perspective view of the subject game table according to the present invention wherein the game table is assembled using the foosball game table.
Figure 2:
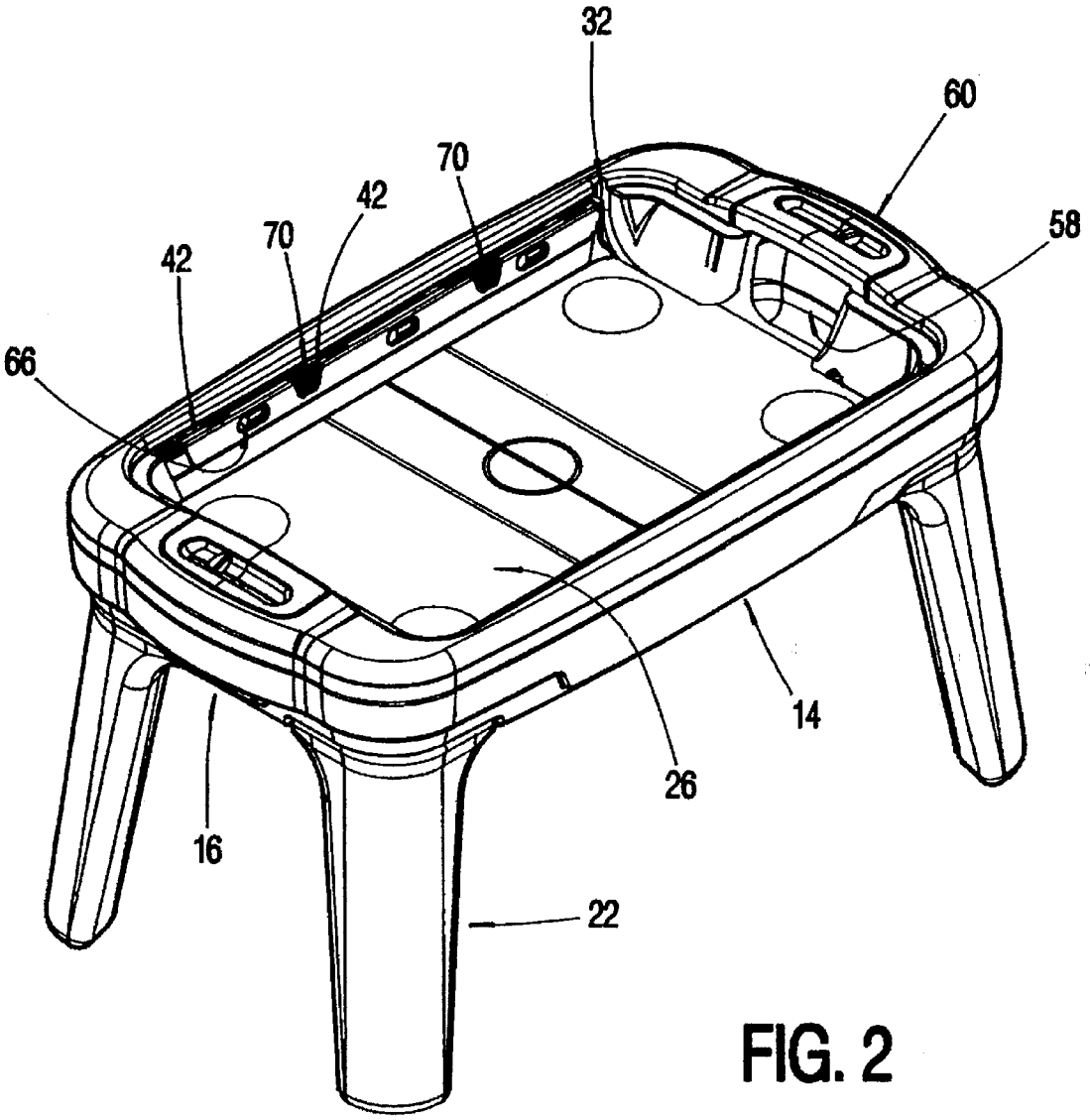
FIG. 2 is a perspective view of the subject game table according to the present invention wherein the game table is assembled using the glide hockey game table.
Figure 3:
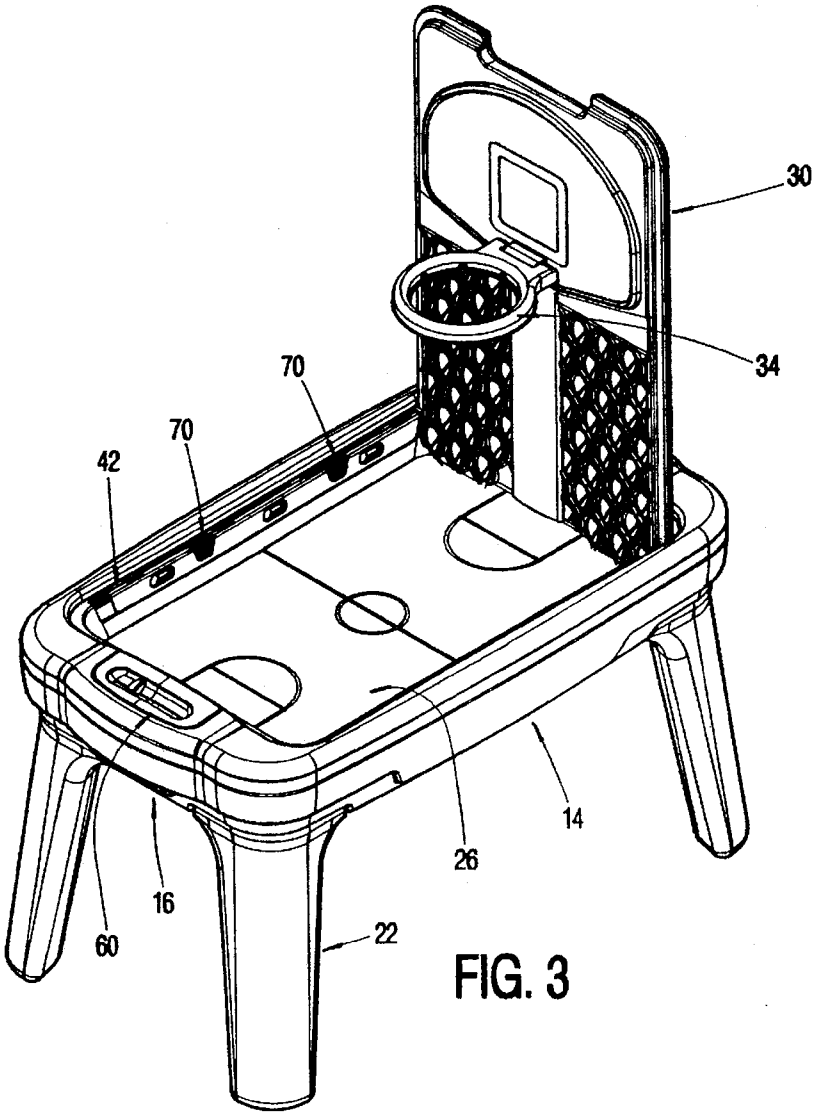
FIG. 3 is a perspective view of the subject game table according to the present invention wherein the game table is assembled using the basketball game table.
Figure 4:
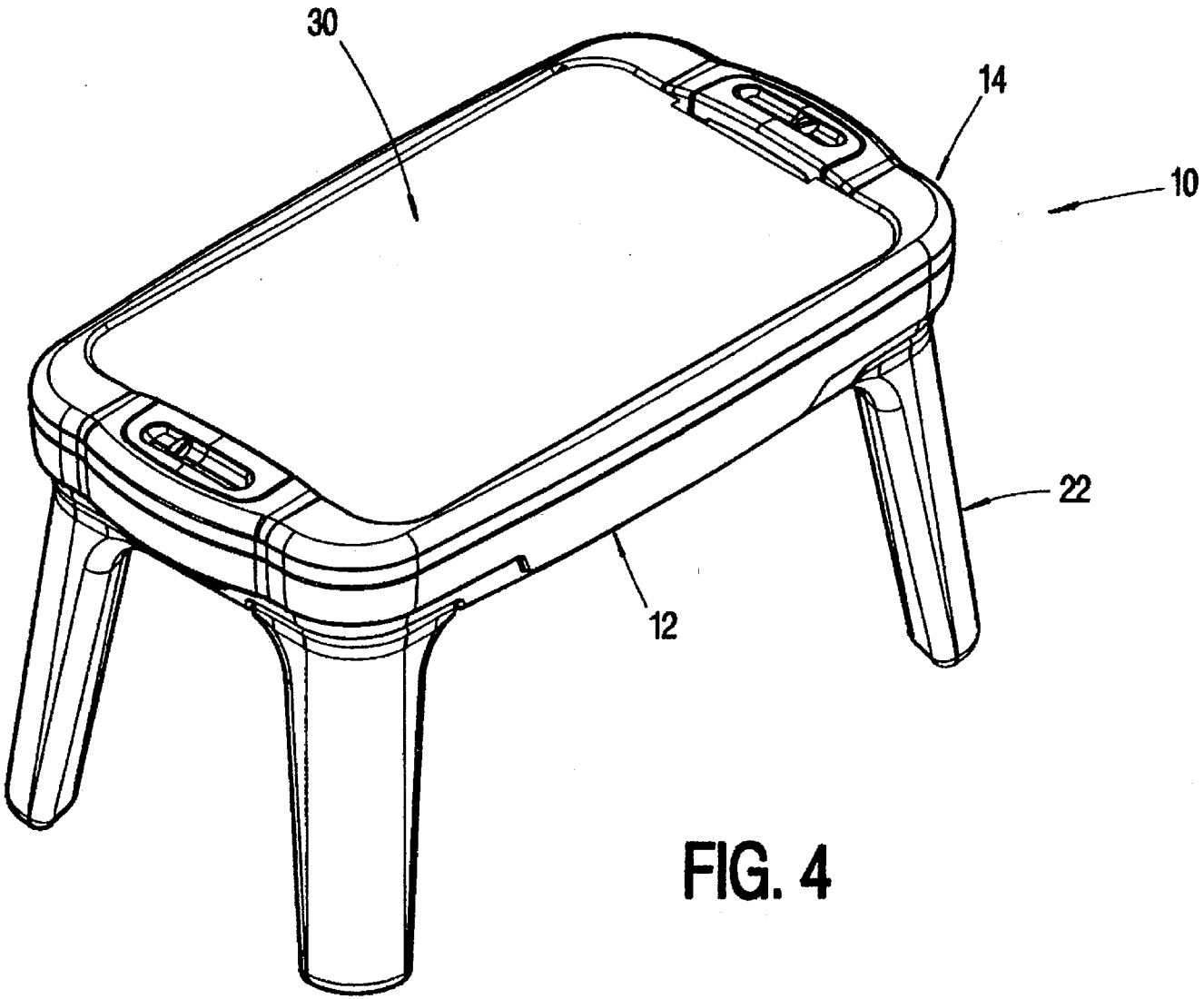
FIG. 4 is a perspective view of the subject game table according to the present invention wherein the game table depicts the drawing table.

Referring to FIG. 1, the subject convertible game table 10 is shown in an assembled condition depicting the foosball game table. The present invention provides for a convertible game table 10 which can be easily assembled and disassembled, so that the convertible game table 10 can be used to play a variety of games including foosball, glide hockey and basketball as illustrated in FIGS. 1–3. The convertible game table 10 can also be used as a drawing table as illustrated in FIG. 4.

Figure 5:
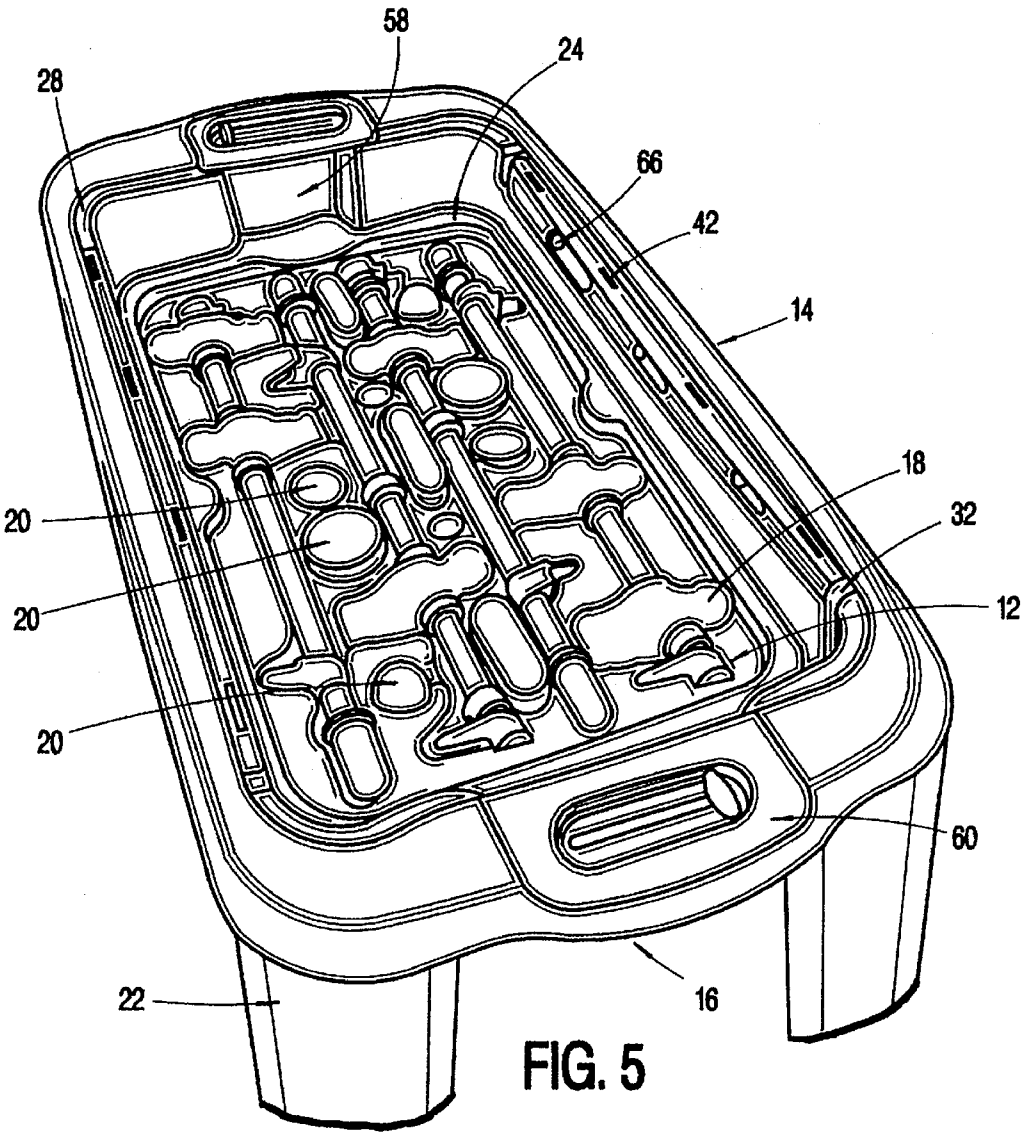
FIG. 5 is a perspective view of the subject game table according to the present invention depicting the first base member of the game table.

The convertible game table 10 is generally rectangular in shape, and includes a first base member 12, two side walls 14 and two end walls 16, extending in a generally upwardly direction from the first base member 12 as illustrated in FIG. 5. Thus, the side walls 14 and end walls 16 provide a continuous walled element surrounding the first base member 12. The first base member 12 may include apertures 18 for receiving and storing the game pieces 20 when one or more of the games is not being played. The table 10 is supported by four legs 22 secured in the approximate corners of a bottom portion of the first base member 12. The legs 22 may be secured to the table 10 in a variety of ways including but not limited to screws and pins. Alternatively, the first base member 12 may rest on the floor or table, such that the convertible game table 10 does not require supporting leg members 22.

FIG. 5 also illustrates a lip 24 extending adjacent to the lower interior of each of the side walls 14 and end walls 16. The lip 24 assists in supporting a second base member 26 such that the second base member 26 is approximately parallel to the first base member 12 as illustrated in FIGS. 1–3. The second base member 26 acts as a game playing surface for the convertible game table 10. In addition, the second base member 26 also acts as the cover for the first base member 12, thereby covering and assisting in storing the game pieces 20 in the apertures 18 within the first base member 12. The dimensions of the second base member 26 allow for the second base member 26 to be easily removed from the convertible game table 10. The removal of the second base member 26 allows for the game pieces 20 to be stored within the apertures 18 of the first base member 12. In addition, the second base member 26 may contain different playing surfaces on either side as illustrated in FIGS. 1–3, thereby increasing the variety of games which may be played with the convertible game table 10.

A second lip 28 is oriented adjacent to the upper edge of the side walls 14 and end walls 16. A cover 30 for the convertible table 10 may be supported on the second lip 28 as illustrated in FIG. 4. The cover 30 for the convertible game table 10 will allow for the convertible game table 10 to be used as a drawing table. In addition, the cover 30 may be used as a backboard for use in playing the basketball game as illustrated in FIG. 3. Specifically, the cover 30 may be oriented in a generally perpendicular direction to the second base member 26 and supported within apertures 32 in a first end of the side walls 14. The apertures 32 are oriented such that they are approximately crosswise from each other, such that the first end of the cover 30 can be easily retained within the apertures 32. One side of the cover 30 contains a removable hoop and net 34 for use in playing the basketball game. Thus by having the ability to change positions and orientations of the cover 30 and second base member 26, numerous games can be played using only one game table and various game pieces.

The convertible game table 10 can be used to play a variety of games including foosball. Since the foosball game requires additional game pieces which must be semi-permanent throughout the time period it is being played, the ease of assembly and disassembly is an important feature of the present invention. As illustrated in FIG. 1, the side walls 14 of the convertible game table 10 assist in supporting game piece activating rod assemblies 36 having spaced simulated miniature players 38 attached.

Figure 6:
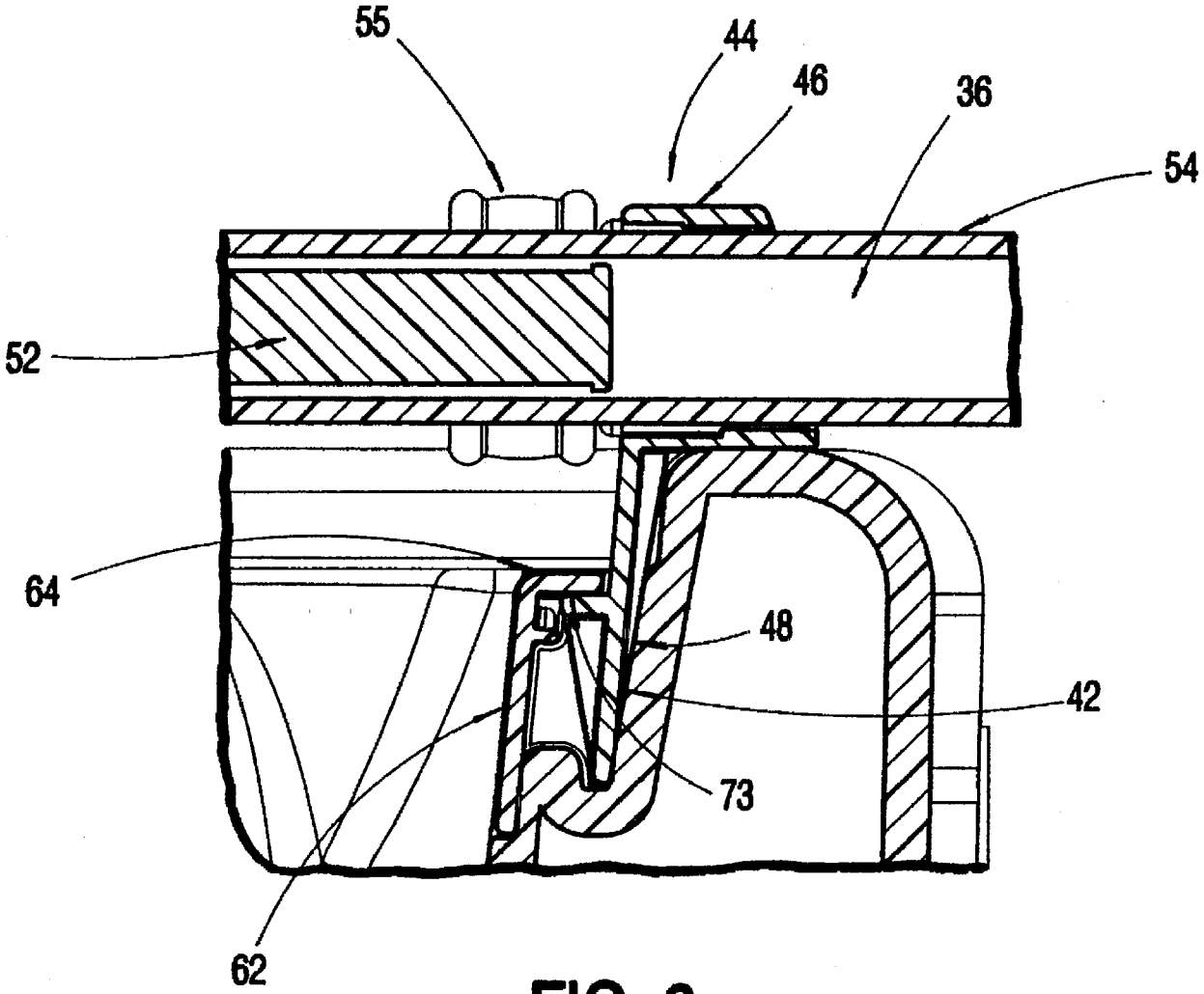
FIG. 6 is a cross-sectional view of the subject game table according to the present invention taken along the lines 6—6 of FIG. 1.
Figure 7:
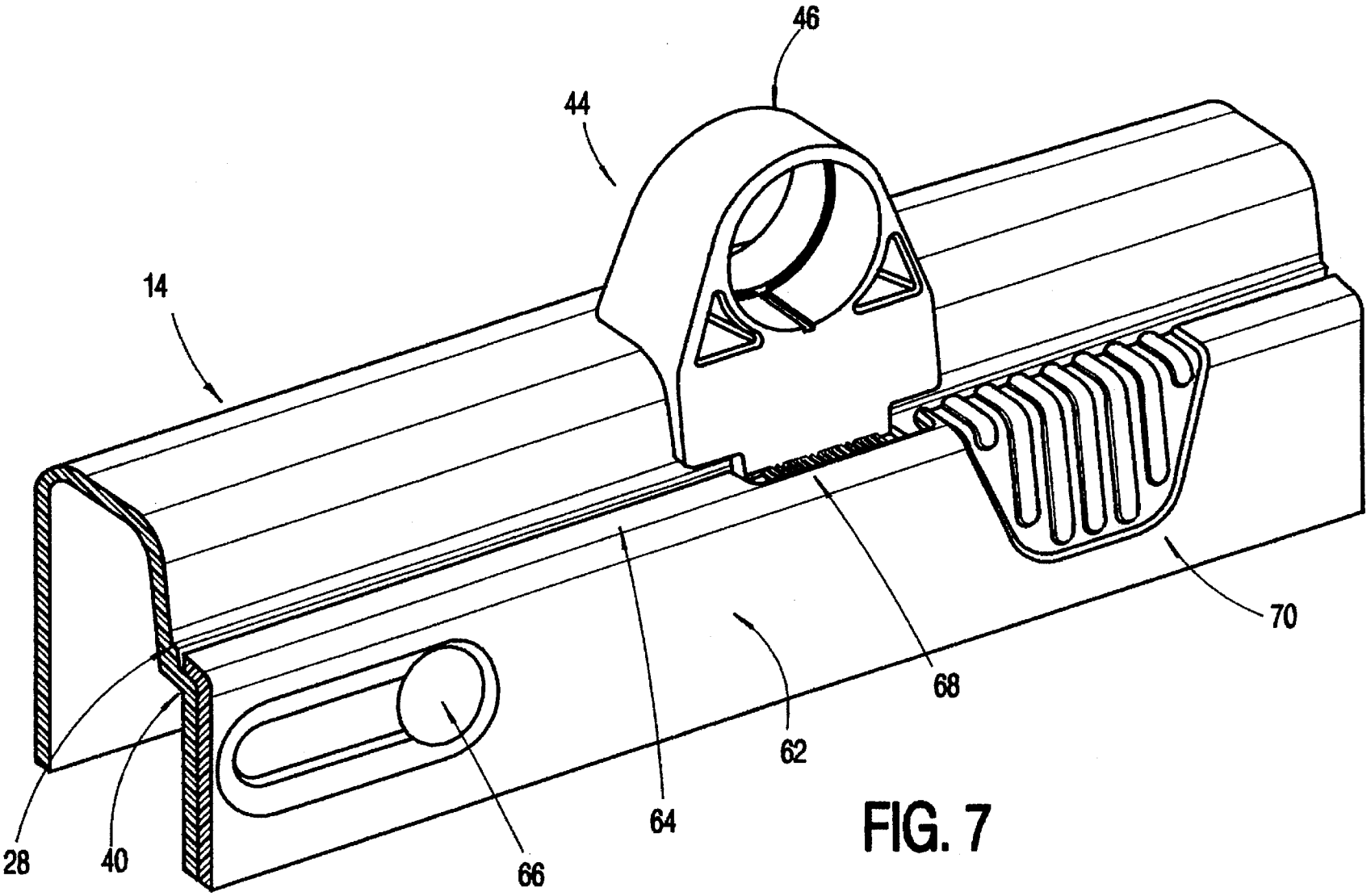
FIG. 7 is a sectional view of the subject game table according to the present invention depicting one of the locking members occupying an open position.

As clearly illustrated in FIGS. 6–9, the interior portion of the side walls 14 contain a flange 40 extending in a direction generally towards the center of the table 10. The flange 40 is oriented between the first lip 24 and the second lip 28. The flange 40 extends generally the length of each of the side walls 14. Recesses 42 extending in a generally downwardly direction are oriented within the side wall flanges 40. The recesses 42 are spaced at approximately equal distances from each other adjacent the two side wall flanges 40. FIG. 5 illustrates four recesses 42 located adjacent each side wall flange 40, whereby the recesses 42 within each side wall flange 40 are oriented approximately crosswise from flanges 40 in the opposite side wall 14. The purpose for the recesses 42 is to assist in retaining a clip member 44 within each of the recesses 42 as illustrated in FIGS. 1 & 7. Thus when the clip members 44 are secured within each of the side wall recesses 42, they are oriented such that they are approximately across from each other. The clip members 44 have an upper curved portion 46 and a lower extending portion 48. The lower extending portion 48 is a size such that it can be received in the side wall recesses 42. The upper portion 46 is generally L shaped and compliments the upper edges of the side walls 14 as illustrated in FIG. 7. When the clip member lower portion 48 is retained within the side wall recesses 42, the lower portion 48 is oriented approximately parallel to the side wall 14, as illustrated in FIG. 6.

As illustrated in FIG. 1, the rod assemblies 36 extend between clip members 44 secured within side wall recesses 42. Each of the rod assemblies 36 consist of a first member 52 and a second member 54, whereby the first member 52 has a smaller diameter than the second member 54. Therefore, in order to extend the rod assembly 36 the second member 54 telescopes over the first member 52. A bushing member 55 may assist in facilitating the connection of the first 52 and second 54 members of each of the rod assemblies 36. The first member 52 of each of the rod assemblies 36 is fixedly retained by a clip member 44. A clip member 44 is oriented approximately adjacent to the end of each of the first members 52. A handle 56 is oriented approximately adjacent to an end of each of the second members 54. A clip member 44 slideably retains the second member 54 of each of the rod assemblies 36 adjacent to the side wails 14. However, the handle 56 allows the user to pivot and rotate the rod assembly 36 including the players 38, to allow the players 38 to contact a ball.

The first end 52 of the rod assembly 36 may be fixedly retained by the clip member 44 by a variety of means including welding, adhesives or screws. By fixedly retaining the first member 52 within a clip member 44, the rod assembly 36 is prevented from extending in an outwardly direction at one end of the rod assembly 36. This helps to prevent injuries to the users, since only the second member 54 will be extending in an outwardly direction away from the table 10. Since the second member 54 has a handle 56 and can be controlled by the user, the user has the ability to control the outwardly extending motion of the rod assembly 36 in the user's direction. Thus, one end of each rod assembly 36 is slideably retained in a clip member 44 and an opposite end of each rod assembly 36 is fixedly retained by an additional clip member 44. Each of the rod assemblies 36 have at least one spaced simulated miniature player 38 attached thereto and the players 38 are adapted to contact a miniature ball on the second base member 26 which acts as a playing surface. The second member 54 of each of the rod assemblies 36 may telescope out or over the first member 52 to align the player 38 with the ball. In addition, the rod assembly 36 may be rotated to pivot a player 38 into direct contact with the ball. FIG. 1 illustrates clip members 44 located adjacent to both ends of each rod assembly 36 carrying players 38, thereby ensuring that both ends of each of the rod assemblies 36 are retained adjacent the side walls 14 via the clip members 44. Goal recess 58 are located within the approximate center of each of the end walls 16. Score keeping means 60 are also located within the approximate center of each of the end walls 16, and are located adjacent to the goal recesses 58.

Figure 8:
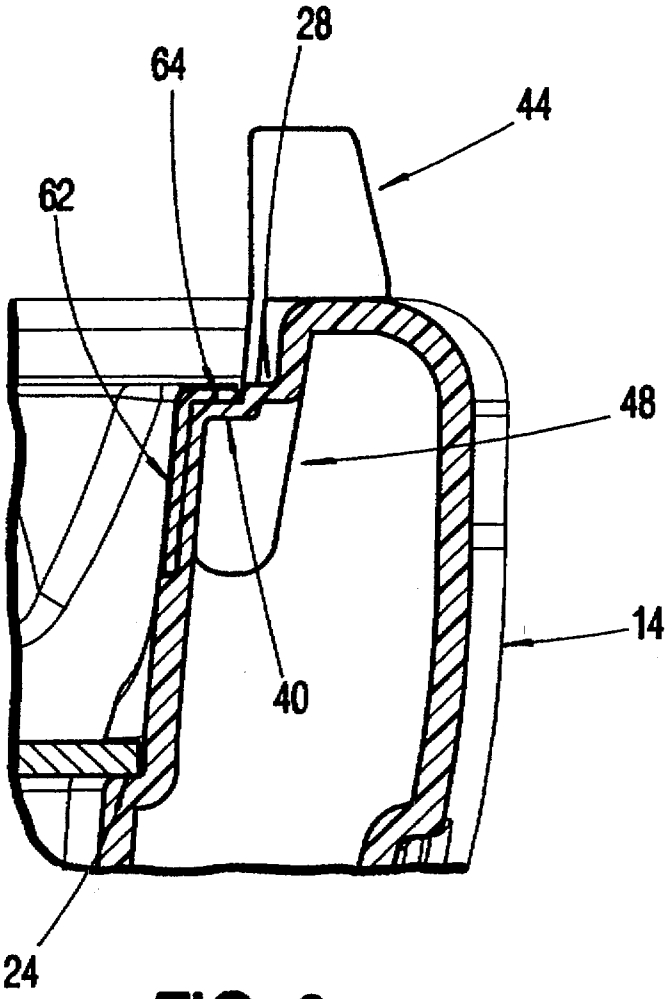
FIG. 8 is a cross sectional view of the subject game table according to the present invention, taken along the lines 8—8 of FIG. 7.

FIGS. 6–8 illustrate a locking member 62. The locking member 62 extends the approximate length of each of the side walls 14, adjacent to the side wall flange 40. The locking member 62 is generally L shaped, and includes a lip 64 oriented along substantially all of the upper portion of the locking member 62. The lip 64 is oriented such that the locking member lip 64 mates with the side wall flange 40. Each of the locking members 62 is slideably secured to a side wall 14 by a variety of means including pins, screws or snap fit fasteners 66. Thus, each of the locking members 62 may slide along a stationary side wall 14 to create an open or closed position for the locking members 62. Each of the locking members 62 also includes numerous recesses 68 within the lip 64 of the locking member 62, whereby the locking member recesses 68 correspond to the number and size of the side wall recesses 42. The locking member recesses 68 and the side wall recesses 42 will align with one another when the locking member 62 is occupying an open position. In contrast the side wall recesses 42 and locking member recesses 68 will not align when the locking member 62 is occupying a closed position.

In addition to the recesses 68 located within the locking member 62, the locking member 62 also contains gripping means 70, whereby the user can easily change the positions of the locking member 62 from an open to a closed position. FIG. 1–3 illustrate gripping means 70 located at two positions on each of the locking members 62. The gripping means 70 may be located in a variety of positions along the locking member 62, however, in FIG. 1–3, the gripping means 70 are located adjacent to two of the locking member recesses 68. In addition, the gripping means 70 may have rib members 72 as illustrated in FIG. 7, to assist the user in slideably moving the locking member 62 between an open and closed position.

Figure 9:
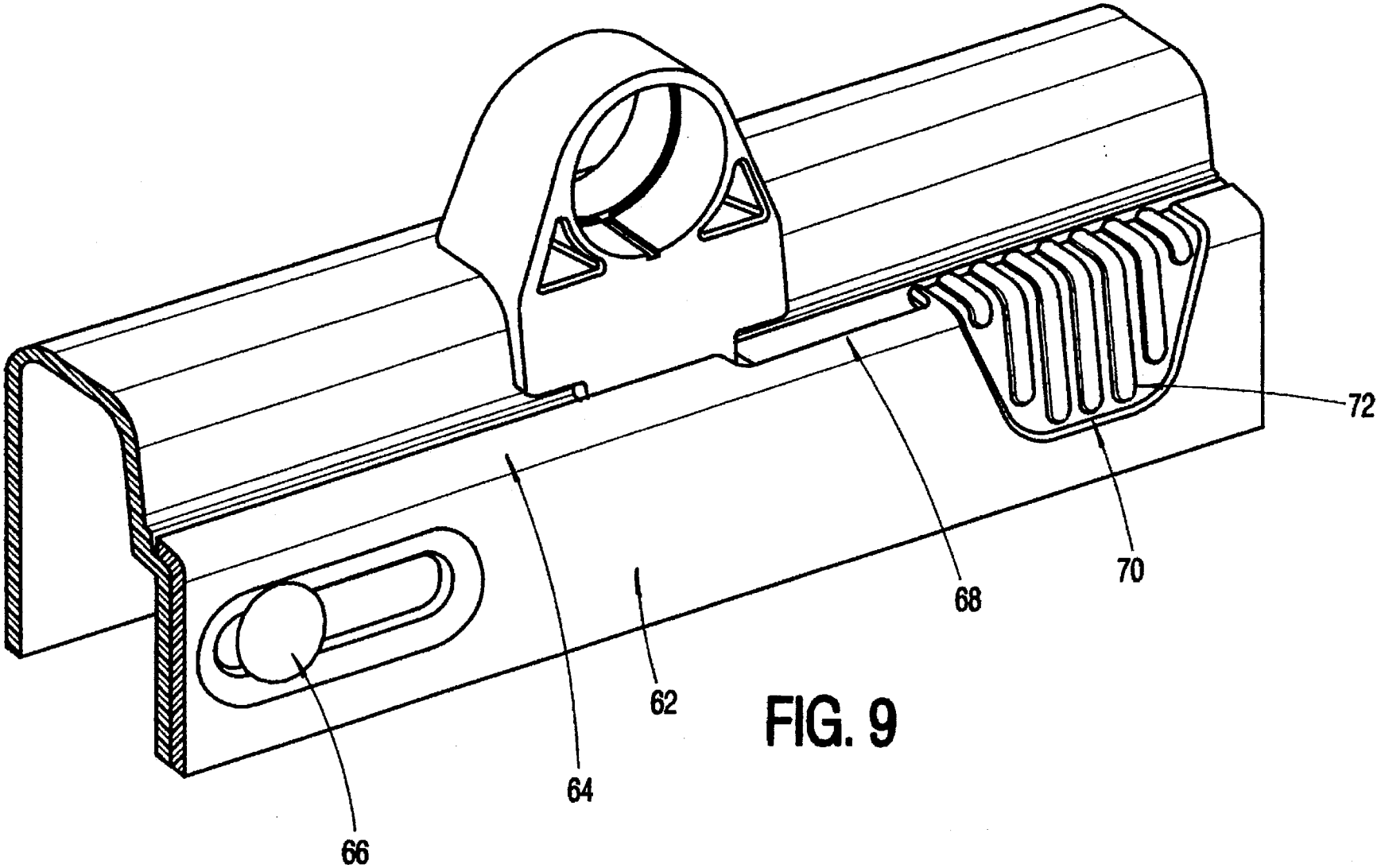
FIG. 9 is a sectional view of the subject game table according to the present invention depicting one of the locking members occupying a closed position.

As illustrated in FIGS. 6–9, the clip member lower extending portion 48 is retained within a side wall recess 42. When the clip member 44 is retained within the side wall recess 42, a protrusion member 73 from the clip member 44 is oriented adjacent the locking member lip 64. Thus, when the user desires that the clip member 44 be detached from the convertible table 10, the locking member 62 should be slideably moved by the gripping means 70 in a direction such that the locking member recesses 68 and the side wall recesses 42 are aligned as illustrated in FIG. 7. Thus, when the side wall recesses 42 and locking member recesses 68 are aligned, the clip member 44 can be easily removed from the side wall recesses 42. When the user desires to ensure that the clip member 44 remains tightly retained within the side wall recesses 42, the user will need to ensure that the locking member recesses 68 are not aligned with the side wall recesses 42 as illustrated in FIG. 9. When the locking member recesses 68 and side wall recesses 42 are not aligned, the lip 64 of the locking member 62 will be overlaying the side wall recesses 42, thereby preventing the clip member 44 from being withdrawn from the side wall recesses 42.

In such a way when the locking member 62 occupies a closed position, the locking member 62 actively ensures that the clip members 44 are retained within the side wall recesses 42. When the locking member 62 is occupying an open position, the clip members 44 may be easily lifted in a generally vertical direction and removed from the side wall recesses 42 as illustrated in FIG. 7. Generally, when the user desires to disassemble the foosball game table either for storage purposes or to play a different game using the convertible table 10, the user should slideably move both of the locking members 62 via the gripping means 70, such that the locking members 62 occupy an open position as illustrated in FIG. 7. The user would need to ensure that the locking members 62 are occupying the open position such that they will not prevent the removal of the clip members 44 from the locking members recesses 68 and side wall recesses 42. To remove the clip members 44 from the side wall recesses 42, each of the rod assemblies 36 can be lifted in a generally upwardly direction at both ends adjacent to the clip members 44. Once the clip members 44 are free of the side wall recesses 42, the locking members 44 may occupy either an open or closed position.

Figure 10:
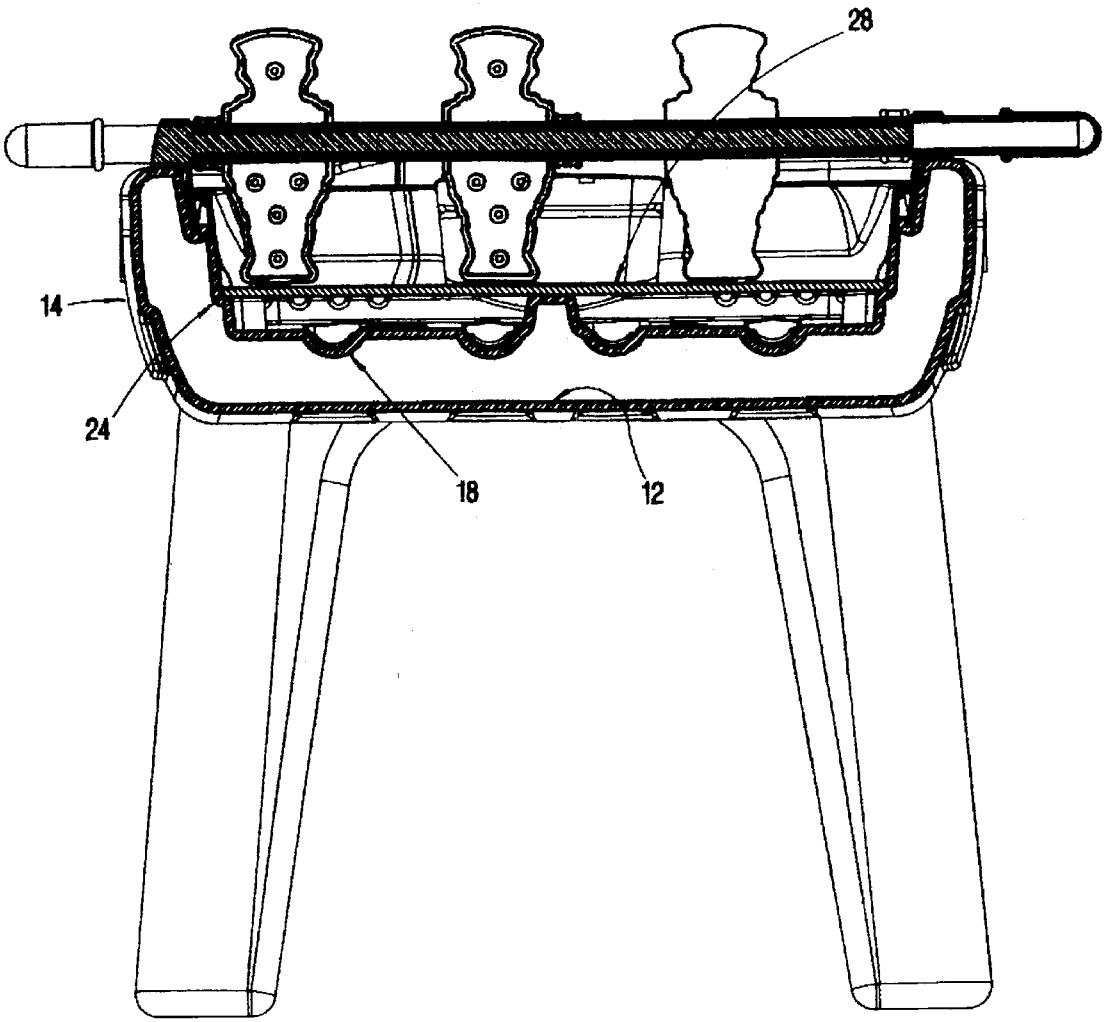
FIG. 10 is a cross-sectional view of the subject game table according to the present invention, taken along the lines 10—10 of FIG. 1.

In order to assist the user in ensuring that all pieces of the convertible game table 10 remain together the clip members 44 and rod assemblies 36 may be stored between the first 12 and second 26 base members. As clearly illustrated in FIGS. 5 & 10, apertures and space exists between the first 12 and second 26 base members for storage of the game pieces 20. The foosball game can easily be assembled again, by ensuring that the locking members 62 are occupying an open position. The clip members 44 should fixedly retain a first member 52 of the rod assembly 36, and slideably retain a second member 54 of the rod assembly. Each of the clip members 44 may then be inserted into the aligned side wall recesses 42 and locking member recesses 62. The locking members 62 should then be slideably moved to a closed position to ensure the clip members 44 remain retained within the side wall recesses 42. The ease of assembly and disassembly of the game pieces in the convertible game table 10 allows for children of various ages to use and enjoy the convertible game table 10.

While the above describes the preferred embodiment of the subject invention, the invention is not intended to be so confined. Other embodiments apparent to those skilled in the art, which utilize the teachings hereof, are intended to be within the scope and spirit of the present invention.

We claim:

1. A convertible game table comprising:

a table having a base member, two side walls and two end walls, said side and said end walls extending in a generally vertical direction from said base member; at least one recess disposed in each of said two side walls;

first clip means for rotatably retaining a first end of at least one rod extending crosswise between said two side walls, and second clip means fixedly retaining a second end of said rod;

locking means oriented adjacent each of said side walls, said locking means for selectively securing said first and said second clip means within said side wall recesses said first and said second clip means further comprising an upper portion having a base being generally L shaped, said upper portion of said first clip means rotatably retaining said first end of said rod, and said upper portion of said second clip means fixedly retaining said second end of said rod.

2. A foosball game table comprising:

a table having a first base and two side walls and two end walls extending in a generally upwardly direction from said first base member, each of said side walls containing at least one recess oriented in said side wall;

at least one rod extending crosswise between said side walls;

clip means oriented adjacent a first end and a second end of said rod, said clip means for retaining said rod;

said clip means comprising an upper portion and a lower portion, said upper portion attaching to said rod, and said lower portion being receivable within one of said side wall recesses;

locking means, oriented adjacent each of said side walls, for selectively securing said lower portion of said clip means within said recess said table further comprising a lip extending along a lower portion of each of said end walls and each of said side walls, said lip for supporting a second base member.

3. A foosball game table according to claim 1, said second base member oriented approximately parallel to said first base member, and being removable from said table, said second base member acting as a cover for a storage area between said first base member and said second base member.

4. A foosball game table comprising:

a table having a first base and two side walls and two end walls extending in a generally upwardly direction from said first base member, each of said side walls containing at least one recess oriented in said side wall;

at least one rod extending crosswise between said side walls;

clip means oriented adjacent a first end and a second end of said rod, said clip means for retaining said rod;

said clip means comprising an upper portion and a lower portion, said upper portion attaching to said rod, and said lower portion being receivable within one of said side wall recesses;

locking means, oriented adjacent each of said side walls, for selectively securing said lower portion of said clip means within said recess said rod further comprising a first member and a second member, said first and said second member being slideably secured together such that said second member can slide over said first member.

5. A foosball game table according to claim 4, one of said clip means being fixedly secured to said first member and said second member being rotatably secured by one of said clip means.

6. A combination basketball and foosball game table comprising:

a first base member being generally rectangular in shape and having a pair of opposing end walls interconnecting with a pair of opposing side walls, said side walls and said end wails extending from said first base member in a generally upwardly direction and providing a walled element around said first base member, said side walls each having at least one recess for receiving a clip member;

four leg members secured to a bottom portion of said first base member;

a first continuous ledge oriented adjacent a generally lower interior portion of each of said side walls and said end walls;

said first continuous ledge for supporting a removable second base member, said second base member oriented such that when said second base member is supported by said first continuous ledge said second base member is approximately parallel to said first base member;

a second continuous ledge oriented adjacent a generally upper interior portion of each of said side and end walls;

storage means, disposed between said first base member and said second base member, for storing game pieces four rods disposed crosswise between said side walls, each of said rods having one of said clip members disposed adjacent to a first end and a second end of said rod, said clip members for retaining said rod;

locking means oriented adjacent to each of said side walls, said locking means selectively locking each of said clip members within one of said recesses.

7. A combination basketball and foosball game table according to claim 6, said game table further comprising a cover being slideably retained within an aperture oriented at a first end of each of said side walls, such that said cover may be oriented approximately perpendicular to said second base member.

8. A combination basketball and foosball game table according to claim 6, said game table further comprising a cover supported by said second continuous ledge, such that said cover is oriented approximately parallel to said first base member.

* * * * *